US008297732B2

(12) United States Patent
Niimi et al.

(10) Patent No.: US 8,297,732 B2
(45) Date of Patent: Oct. 30, 2012

(54) PRINTING APPARATUS AND CLEANER UNIT FOR CLEANING INKJET HEAD AND INK CONVEYER TUBE

(75) Inventors: Akiko Niimi, Kasugai (JP); Kazuyuki Kondo, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 319 days.

(21) Appl. No.: 12/654,207

(22) Filed: Dec. 14, 2009

(65) Prior Publication Data

US 2010/0245461 A1 Sep. 30, 2010

(30) Foreign Application Priority Data

Mar. 27, 2009 (JP) ..... 2009-078411

(51) Int. Cl.
*B41J 2/165* (2006.01)

(52) U.S. Cl. ..... 347/25; 347/28

(58) Field of Classification Search ..... 347/25, 347/28

See application file for complete search history.

(56) References Cited

U.S. PATENT DOCUMENTS

| | | | | |
|---|---|---|---|---|
| 4,482,648 | A * | 11/1984 | Norman | 521/65 |
| 5,786,829 | A * | 7/1998 | Pasciak et al. | 347/28 |
| 5,825,380 | A * | 10/1998 | Ichizawa et al. | 347/28 |
| 5,917,512 | A * | 6/1999 | Weber et al. | 347/28 |
| 5,923,347 | A * | 7/1999 | Wade | 347/28 |
| 6,196,657 | B1 * | 3/2001 | Hawkins et al. | 347/28 |
| 6,375,301 | B1 * | 4/2002 | Childers et al. | 347/28 |
| 2001/0003291 | A1 * | 6/2001 | Uematsu et al. | 137/888 |
| 2001/0047962 | A1 * | 12/2001 | Zha et al. | 134/36 |
| 2002/0012019 | A1 * | 1/2002 | Seino | 347/19 |
| 2004/0223026 | A1 * | 11/2004 | Chiun | 347/22 |
| 2005/0099470 | A1 | 5/2005 | Nishino | |
| 2005/0248608 | A1 | 11/2005 | DeVivo et al. | |
| 2007/0076063 | A1 * | 4/2007 | Ohnishi et al. | 347/86 |
| 2010/0103229 | A1 | 4/2010 | Ikushima | |

FOREIGN PATENT DOCUMENTS

| | | | |
|---|---|---|---|
| EP | 1 070 592 | A1 | 1/2001 |
| JP | A-08-127981 | | 5/1996 |
| JP | A-11-78044 | | 3/1999 |
| JP | A-2003-182095 | | 7/2003 |
| JP | A-2003-211702 | | 7/2003 |
| JP | A-2005-153514 | | 6/2005 |
| WO | WO 2005/108096 | A1 | 11/2005 |
| WO | WO 2008/126420 | A1 | 10/2008 |

OTHER PUBLICATIONS

Japanese Office Action issued in Japanese Application No. 2009-078411 dated Jun. 7, 2011 (with translation).

Search Report issued in European Patent Application No. 09180358.5, dated Jul. 6, 2010.

European Office Action issued in European Patent Application No. 09 180 358.5; mailed Sep. 2, 2011.

* cited by examiner

*Primary Examiner* — Shelby Fidler
(74) *Attorney, Agent, or Firm* — Oliff & Berridge, PLC

(57) ABSTRACT

A cleaner unit to clean an inkjet head, ejecting ink onto a recording medium, and an ink conveyer tube, conveying the ink to the inkjet head, of an inkjet printer in cleaning liquid, is provided. The cleaner unit includes an air-liquid two-phased cleaner conveyer tube, which conveys air-liquid two-phased cleaner, and a cleaner spout, which is connected to an upstream-side end of the ink conveyer tube and to a downstream-side end of the air-liquid two-phased cleaner conveyer tube with respect to a fluid flow, and through which the air-liquid two-phased cleaner is supplied to the ink conveyer tube.

19 Claims, 14 Drawing Sheets

PRINTING APPARATUS AND CLEANER UNIT FOR CLEANING INKJET HEAD AND INK CONVEYER TUBE

CROSS REFERENCE TO RELATED APPLICATION

This application claims priority from Japanese Patent Application No. 2009-078411, filed on Mar. 27, 2009, the entire subject matter of which is incorporated herein by reference.

BACKGROUND

1. Technical Field

An aspect of the present invention relates to a cleaner unit to clean a print head of a printing apparatus, a printing apparatus having the print head, and a method to clean the printing apparatus.

2. Related Art

Conventionally, an inkjet printer to eject inks onto a recording medium, such as a piece of paper and fabric (e.g., a T-shirt), to print an image has been known. The inkjet printer includes an ink tank to store ink, a print head to eject the ink therefrom, and an ink conveyer tube to supply the ink stored in the ink tank to the print head. When the inkjet printer is left unused for a while, the ink remaining in the inkjet head may dry and adhere thereto. Further, the ink may deposit in the ink conveyer tube. Therefore, in order to prevent such deteriorated condition of the inkjet printer, periodic maintenance of the inkjet printer is required.

In order to maintain the operating condition of the inkjet printer, for example, cleaner liquid may be used in place of the ink to the ink conveyer and the inkjet head. According to this cleaning method, the ink remaining in the ink conveyer tube and the print head can be flushed off by the cleaner liquid.

SUMMARY

The inkjet printer may use white ink, which contains titanium dioxide and therefore has higher specific gravity of colorant with respect to gravities of colorants in the other colored inks. When the white ink is used, the colorant may deposit and remain at lower portions of the ink conveyer tube, and such remaining ink may not easily be removed by the cleaner liquid in the above method. In order to remove the remaining ink, a larger amount of cleaner liquid may be flushed for a longer period of time. Such enhanced maintenance operation requires a longer period of time and increases the amount of cleaner liquid to be used. Further, depending on postures and/or shapes of the ink conveyer tube, even with the enhanced maintenance operation, removing the remaining ink off of the ink conveyer tube sufficiently may still be difficult.

The removing ability in the cleaning method may be improved, for example, by increasing an amount of surfactant agent in the cleaner liquid. However, before and during the maintenance operation, bubbles may be generated in the cleaner liquid, and the bubbles generated in the highly concentrated surfactant agent tend to remain longer in the ink conveyer tube even after the maintenance operation. When the bubbles remain in the ink conveyer tube, a flow path for the ink is narrowed, and the ink supplying ability of the ink conveyer tube is lowered. Further, the bubbles in the ink conveyer tube can be conveyed to the inkjet head and may cause failure of ink ejection during a printing operation.

In view of the above drawbacks, the present invention is advantageous in that a cleaner unit to sufficiently clean the print head and the ink conveyer tube in a less complicated manner, is provided. Further, an inkjet printer having such a cleaner unit and a method to clean the inkjet printer are provided.

According to an aspect of the present invention, a cleaner unit to clean an inkjet head, ejecting ink onto a recording medium, and an ink conveyer tube, conveying the ink to the inkjet head, of an inkjet printer in cleaning liquid is provided. The cleaner unit includes an air-liquid two-phased cleaner conveyer tube, which conveys air-liquid two-phased cleaner, and a cleaner spout, which is connected to an upstream-side end of the ink conveyer tube and to a downstream-side end of the air-liquid two-phased cleaner conveyer tube with respect to a fluid flow, and through which the air-liquid two-phased cleaner is supplied to the ink conveyer tube.

According to another aspect of the present invention, an inkjet printing apparatus is provided. The inkjet printing apparatus includes an inkjet head, which is configured to eject ink to form an image on a recording medium, an ink supplying unit, which is configured to contain the ink to be supplied to the inkjet head, an ink conveyer tube, which is configured to connect the ink supplying unit with the inkjet head and convey the ink to the inkjet head, and a cleaner unit to clean the inkjet head and the ink conveyer tube in cleaning liquid. The cleaner unit includes an air-liquid two-phased cleaner conveyer tube, which conveys air-liquid two-phased cleaner, and a cleaner spout, which is connected to an upstream-side end of the ink conveyer tube and to a downstream-side end of the air-liquid two-phased cleaner conveyer tube with respect to a fluid flow, and through which the air-liquid two-phased cleaner is supplied to the ink conveyer tube.

According to still another aspect of the present invention, a method to clean an inkjet head an ink conveyer tube of an inkjet printer in cleaning liquid is provided. The inkjet head ejects ink onto a recording medium, and the ink conveyer tube conveys the ink to the inkjet head. The inkjet head and the ink conveyer tube are cleaned by blending air in the cleaner liquid to generate air-liquid two-phased cleaner, and supplying the air-liquid two-phased cleaner to the ink conveyer tube and the inkjet head.

BRIEF DESCRIPTION OF THE ACCOMPANYING DRAWINGS

Figure 4:
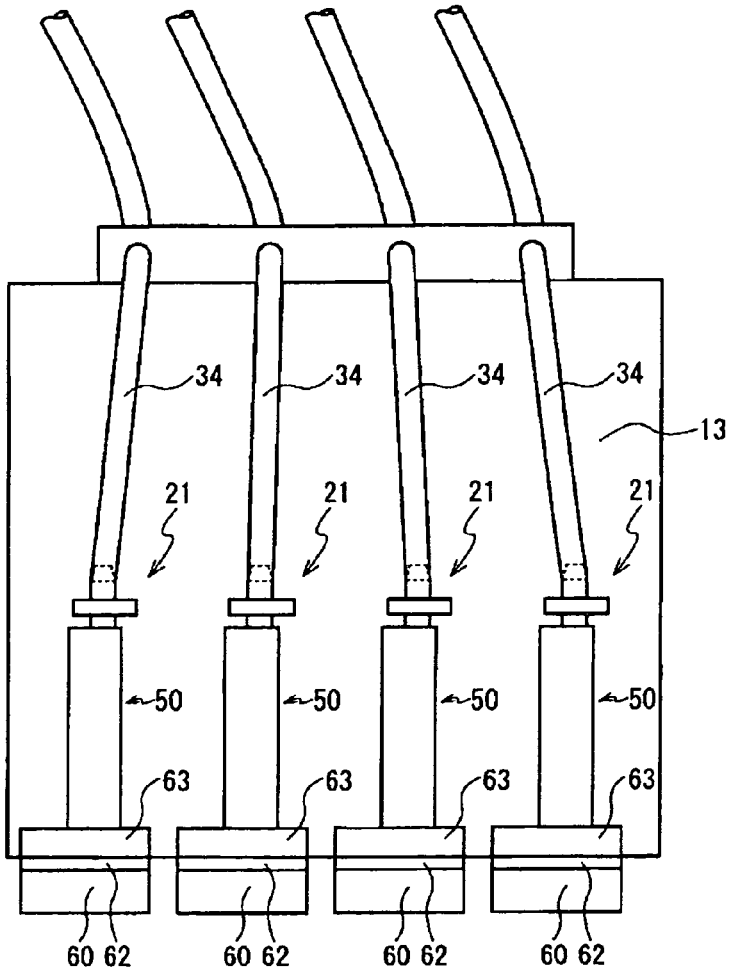

FIG. 4 is a front view of first print heads 21 and ink conveyer tubes 34 in the inkjet printer 1 according to the embodiment of the present invention.

Figure 5:
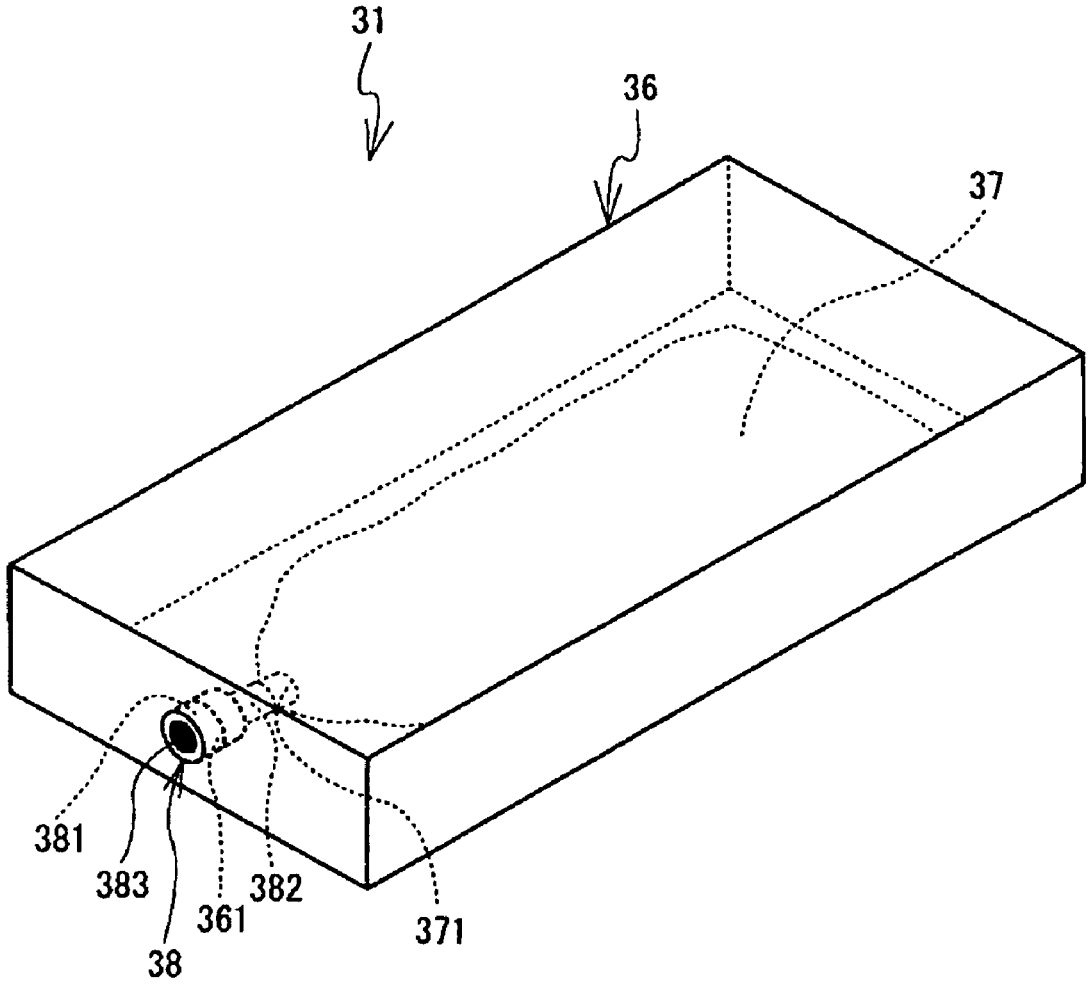

FIG. 5 is a perspective view of a first ink supplying unit 31 according to the embodiment of the present invention.

Figure 6:
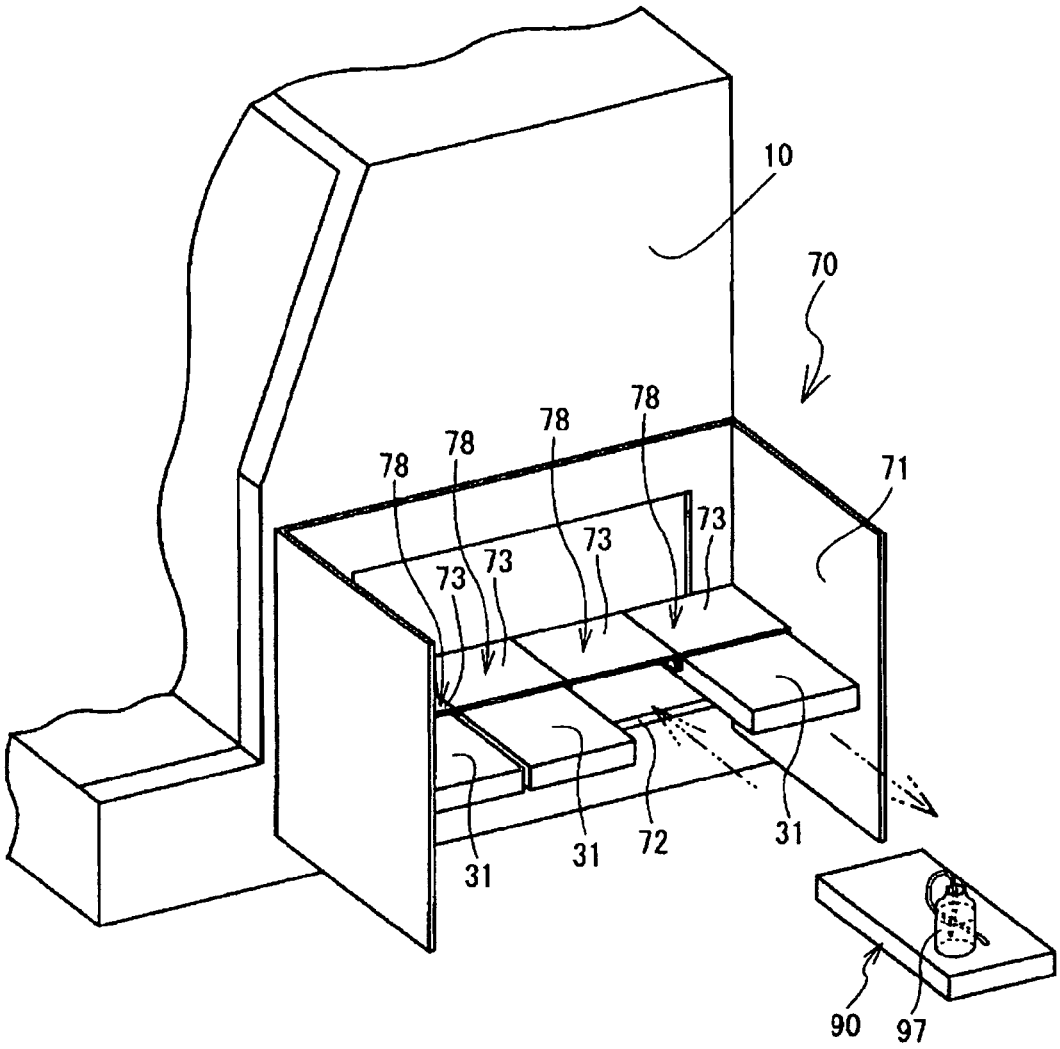

FIG. 6 is a perspective view of a first attachment section 70 of the inkjet printer 1 according to the embodiment of the present invention.

Figure 7:
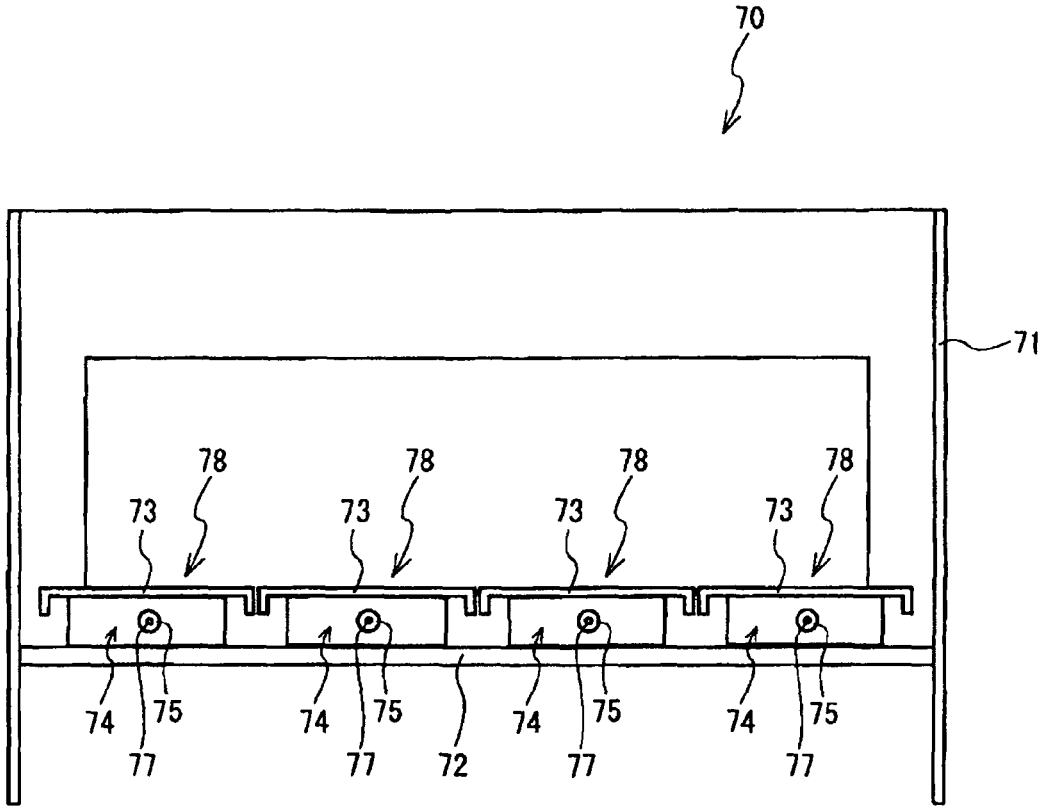

FIG. 7 is a side view of the first attachment section 70 of the inkjet printer 1 according to the embodiment of the present invention.

Figure 8:
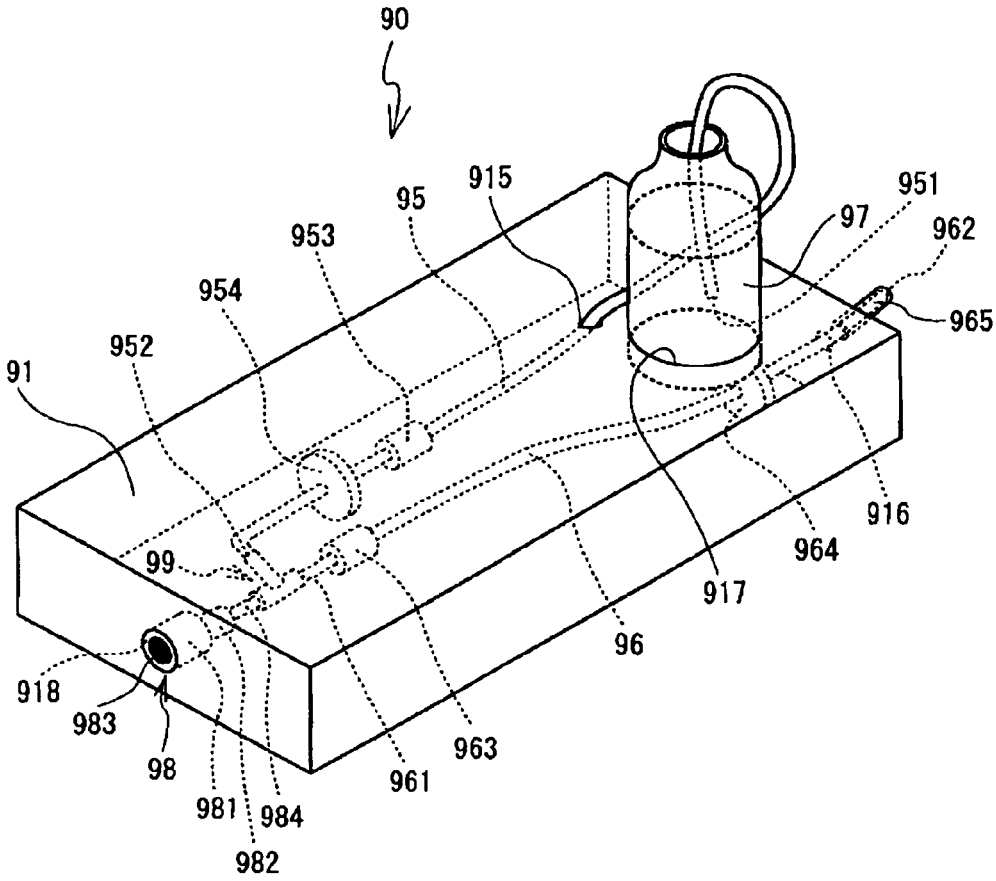

FIG. 8 is a perspective view of a cleaner processing unit 90 of the inkjet printer 1 according to the embodiment of the present invention.

Figure 9:
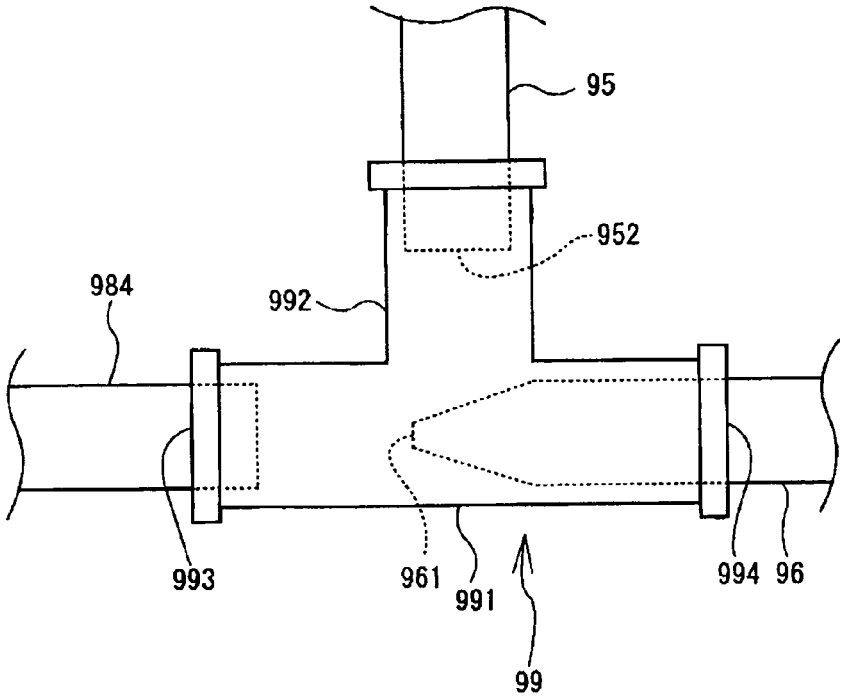

FIG. 9 is a plane view of a three-way tube 99 installed in the cleaner processing unit 90 according to the embodiment of the present invention.

Figure 10:
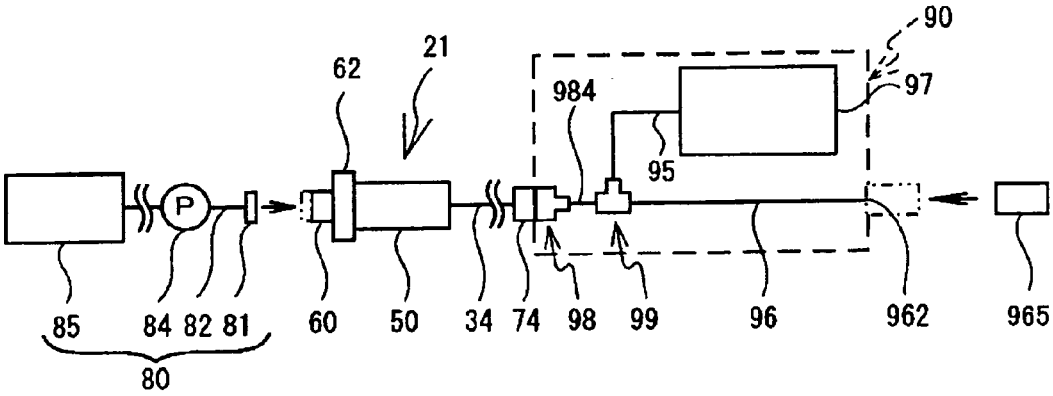

FIG. 10 is an illustrative view of a first cleaning system 80, the first print head 21, and the cleaner processing unit 90 in the inkjet printer 1 according to the embodiment of the present invention.

Figure 11:
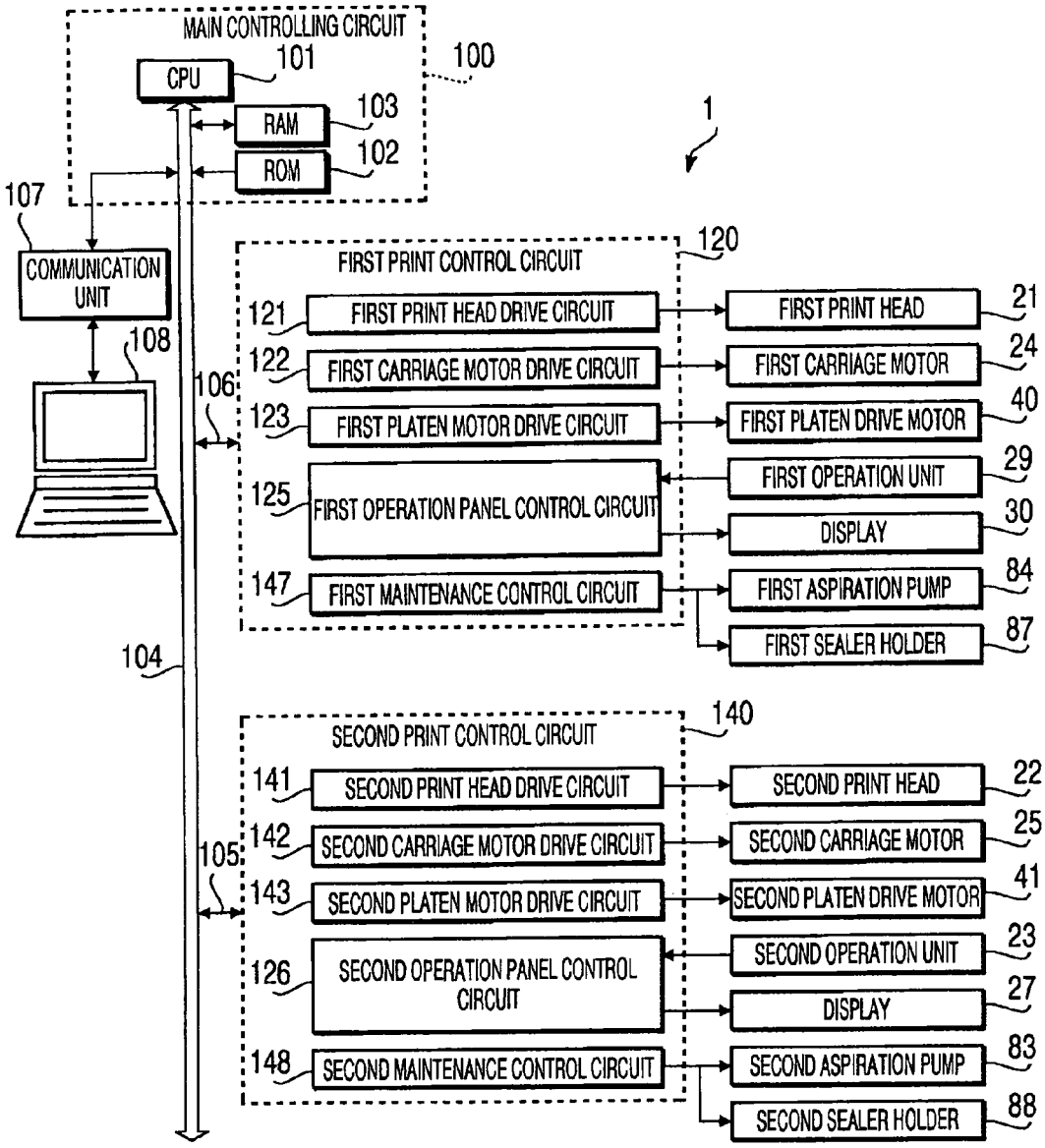

FIG. 11 is a block diagram to illustrate electrical configuration of the inkjet printer 1 according to the embodiment of the present invention.

Figure 12:
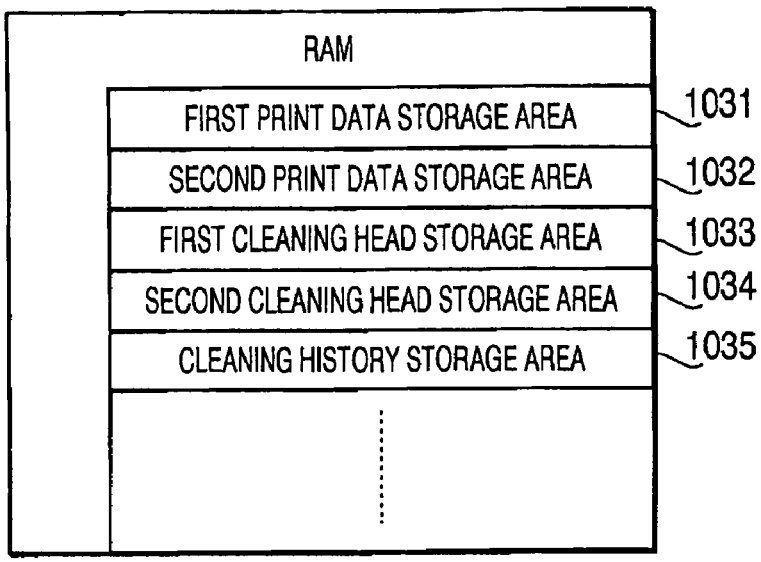

FIG. 12 illustrates storage areas in a RAM 103 of the inkjet printer 1 according to the embodiment of the present invention.

Figure 13:
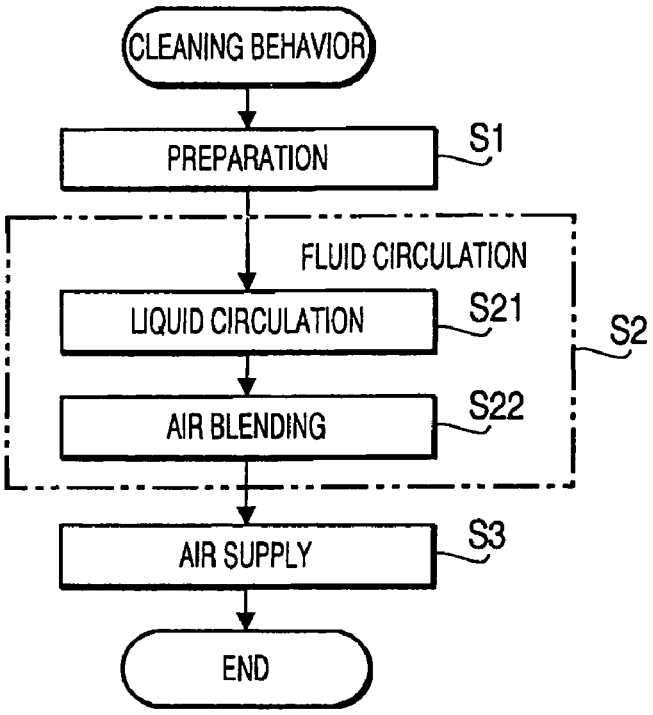

FIG. 13 is a flowchart to illustrate cleaning behaviors of the inkjet printer 1 according to the embodiment of the present invention.

Figure 14:
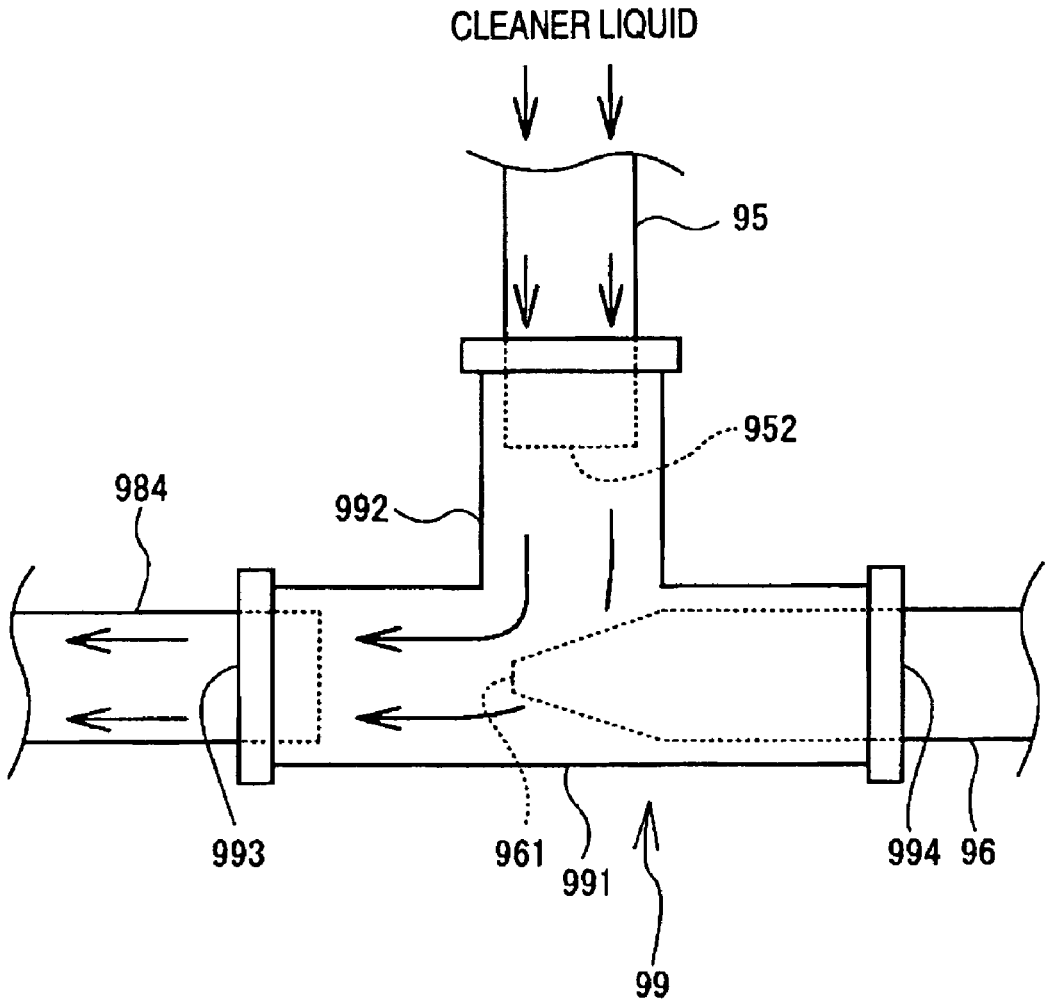

FIG. 14 illustrates a flow path of the cleaner liquid in the three-way tube 99 in a liquid circulation step in the inkjet printer 1 according to the embodiment of the present invention.

Figure 15:
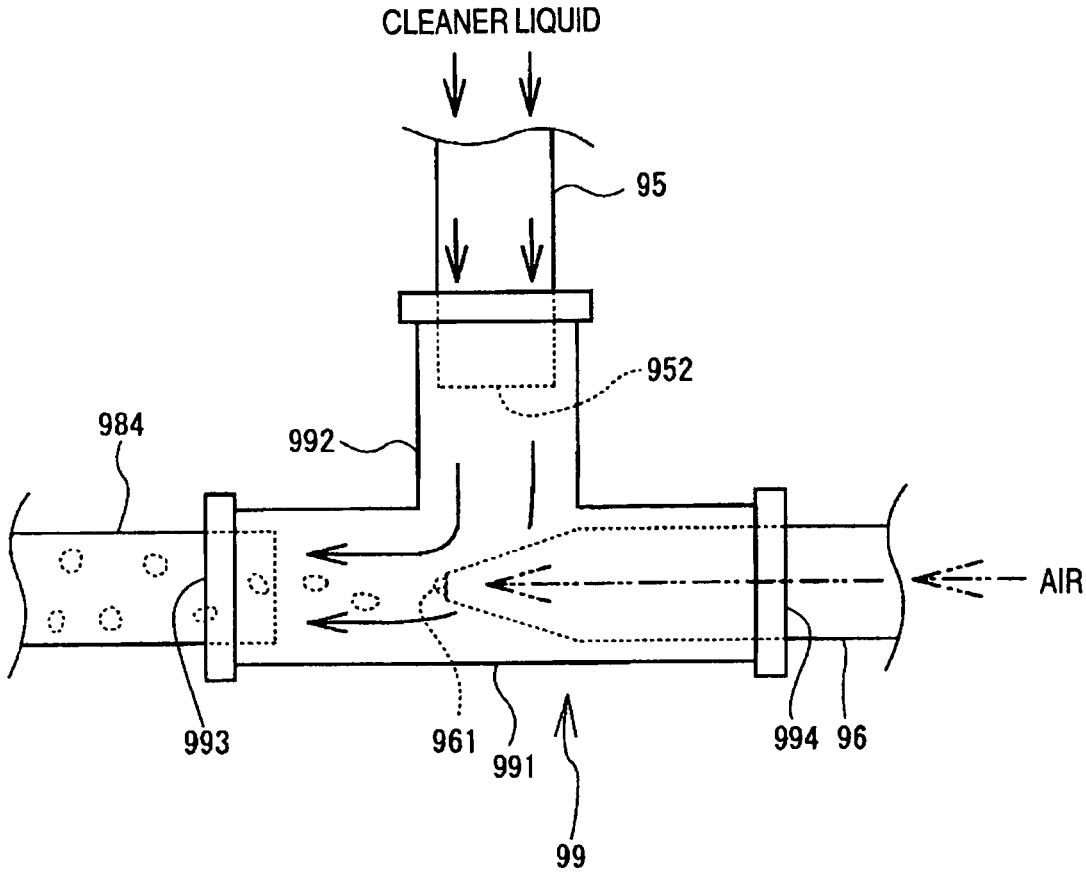

FIG. 15 illustrates flow paths of the cleaner liquid and air in the three-way tube 99 in an air blending step in the inkjet printer 1 according to the embodiment of the present invention.

Figure 16:
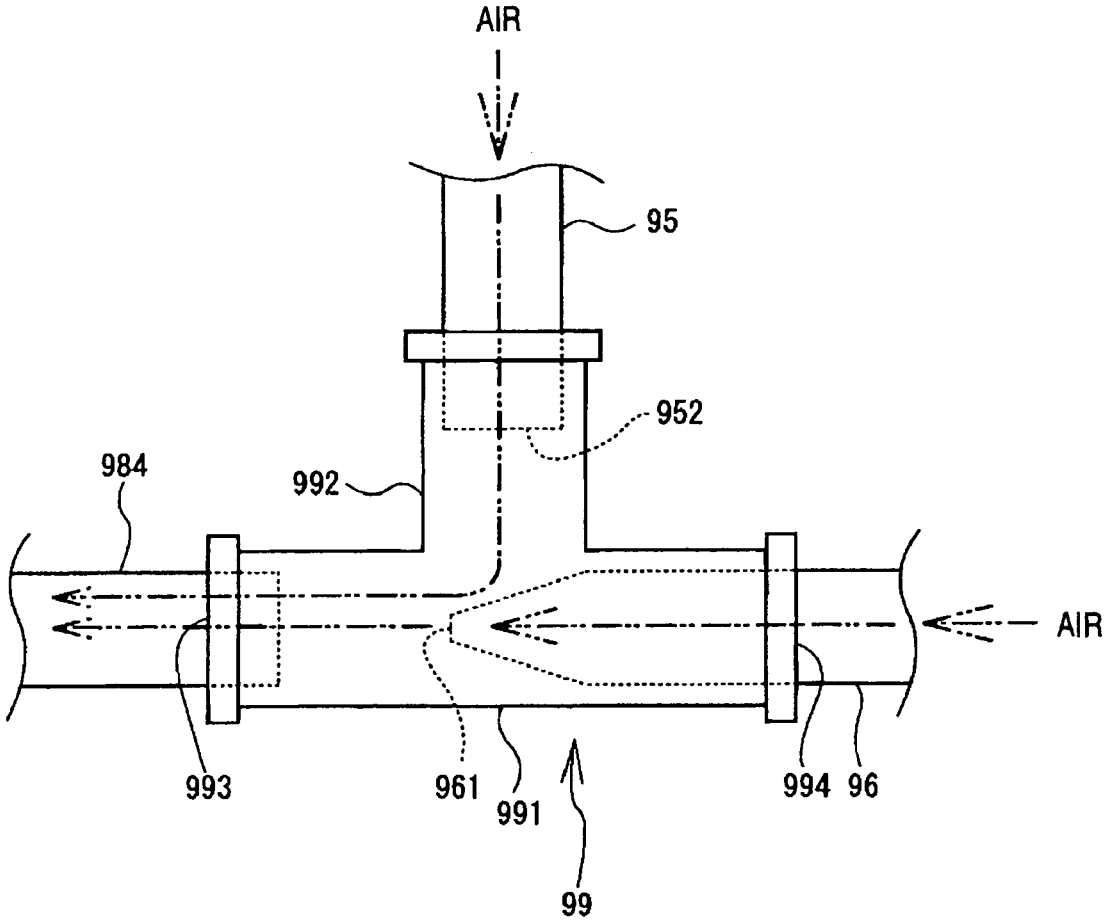

FIG. 16 illustrates flow paths of the air in the three-way tube 99 in an air supply step in the inkjet printer 1 according to the embodiment of the present invention.

Figure 17:
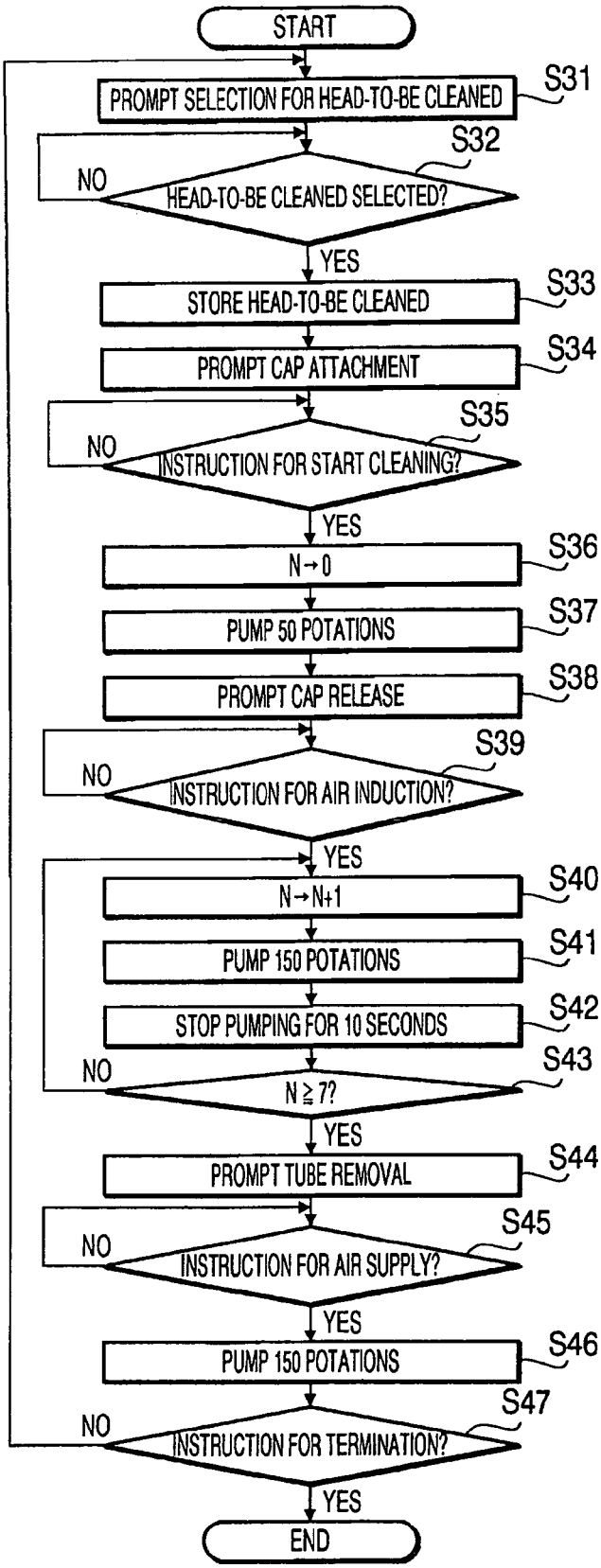

FIG. 17 is a flowchart to illustrate a cleaning operation of the inkjet printer 1 according to the embodiment of the present invention.

DETAILED DESCRIPTION

Hereinafter, an embodiment according to the present invention will be described with reference to the accompanying drawings. Firstly, an overall configuration of an inkjet printer 1 according to the present embodiment will be described with reference to FIGS. 1 through 3. In the following description, a lower-left side, an upper-right side, a lower-right side, and an upper-left side in FIG. 1 correspond to frontward, rearward, rightward, and leftward of the inkjet printer 1 respectively. Further, a right-left direction of the inkjet printer 1 corresponds to a main scanning direction of first print heads 21 and second print heads 22, which will be described later in detail.

Figure 1:
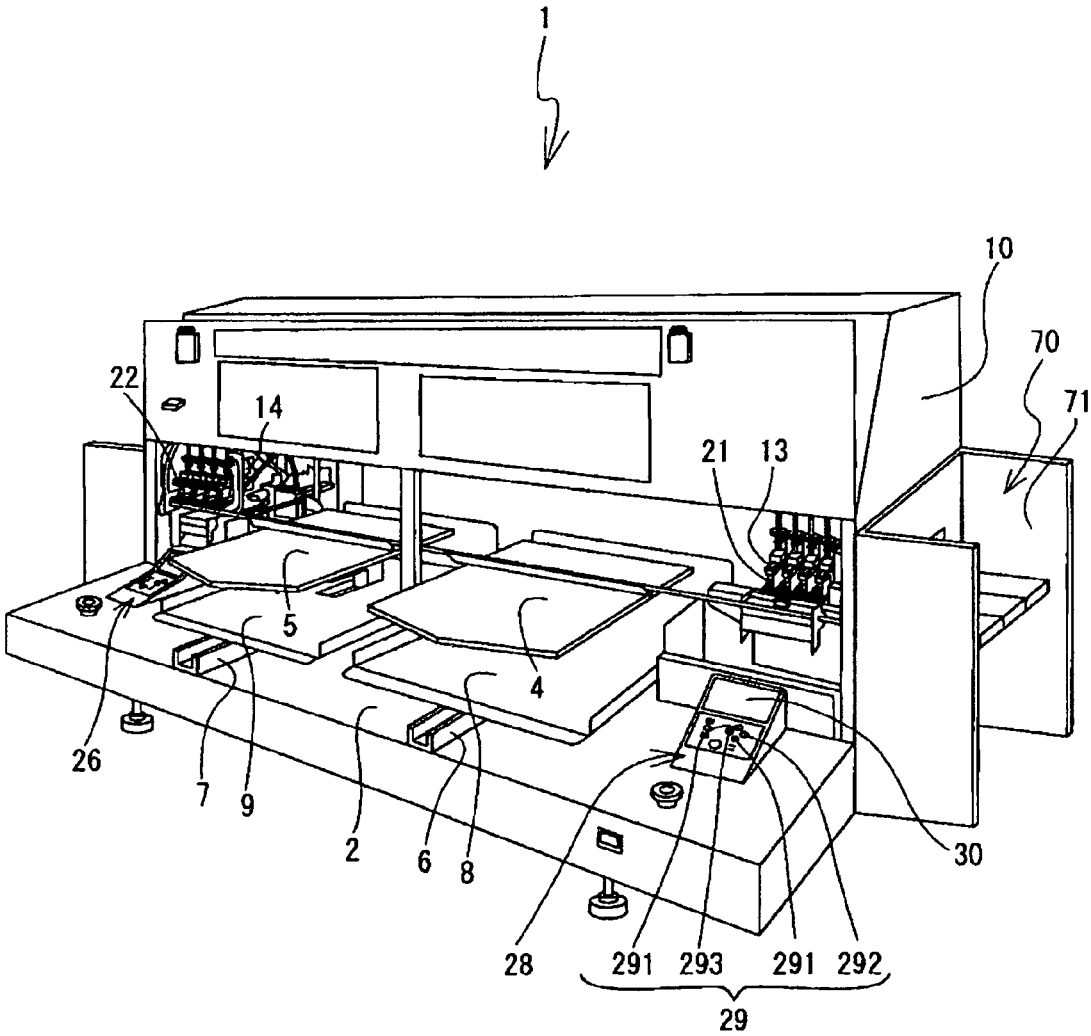
FIG. 1 is a perspective view of an inkjet printer 1 according to an embodiment of the present invention.
Figure 2:
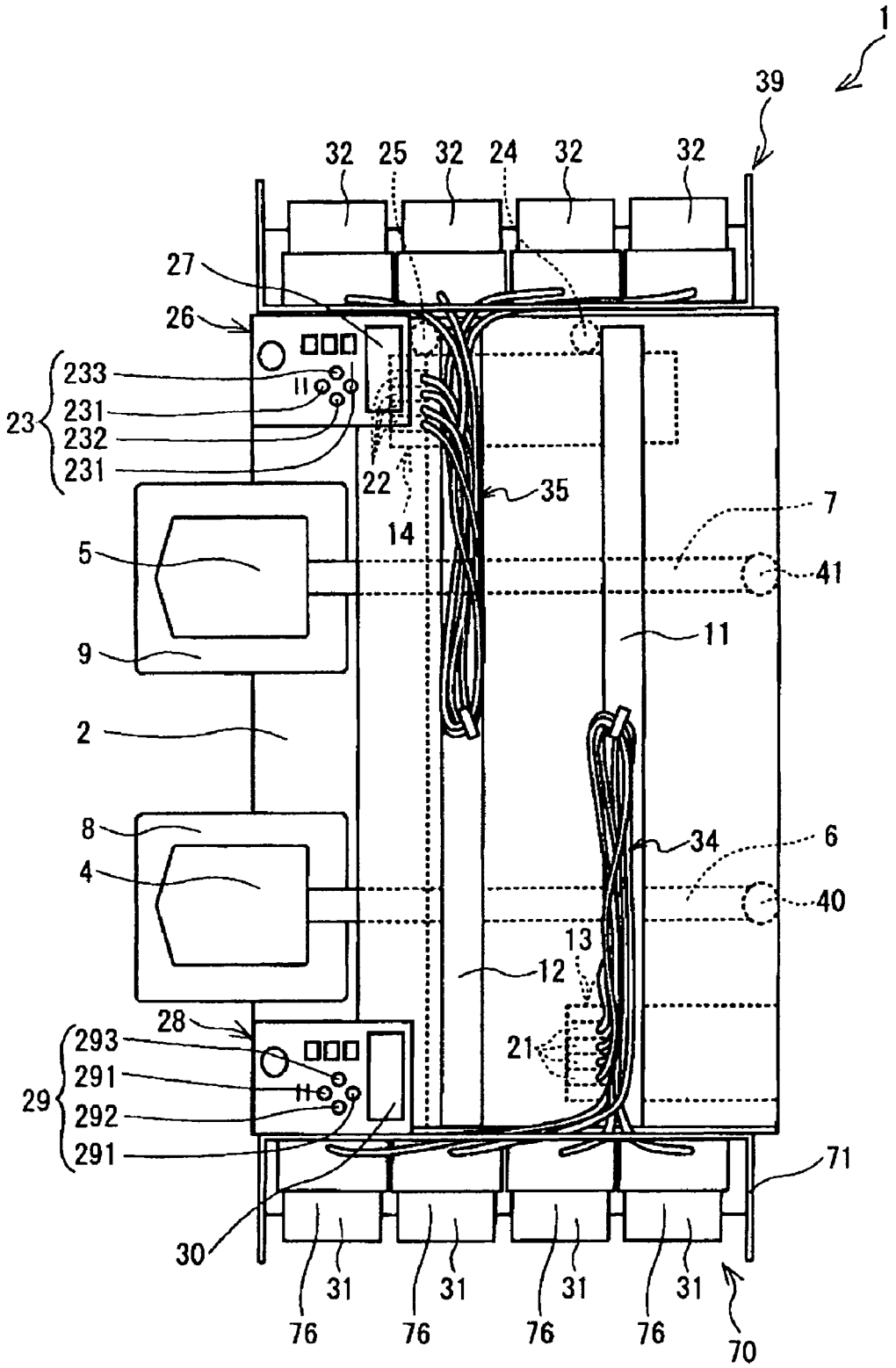
FIG. 2 is a plane view of the inkjet printer 1 according to the embodiment of the present invention.

The inkjet printer 1 is a known inkjet printing apparatus, capable of printing an image on a piece of fabric in an inkjet method. As shown in FIGS. 1 and 2, the inkjet printer 1 is provided with a flat base 2 at a bottom and a chassis 10 to cover the entire body of the inkjet printer 1.

Figure 3:
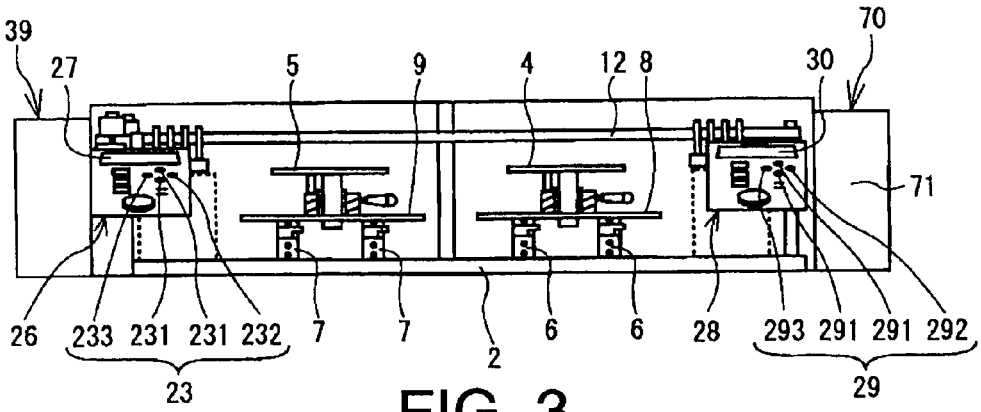
FIG. 3 is a front view of the inkjet printer 1 according to the embodiment of the present invention.

A printing mechanism of the inkjet printer 1 will be described. As shown in FIGS. 2 and 3, the inkjet printer 1 is provided at its upper portion with a guide rail 11, which extends in the right-left direction of the inkjet printer 1. The inkjet printer 1 has first print heads 21 and second print heads 22 to form an image on the recording medium in inks ejected from nozzle surfaces of the first and the second print heads 21, 22 according to image data. The first print heads 21 are to eject white ink from the nozzle surfaces thereof and mounted on a carriage 13, which is reciprocated in the right-and-left direction along the guide rail 11. In the vicinity of the right-hand end of the first guide rail 11, a first carriage motor 24 to drive the first inkjet heads 21 is provided. When the first carriage motor 24 is activated, the first carriage 13 is reciprocated along the first guide rail 11 in the right-left direction. A first cleaning unit 80, which will be described later in detail, is situated below a right end portion of the first guide rail 11.

The inkjet printer 1 is equipped with a guide rail 12, which is arranged in parallel with the second guide rail 12, to guide a carriage 14 with second inkjet heads 22 being mounted. The second inkjet heads 22 are to eject colored inks from the nozzle surfaces thereof. In the vicinity of the left-hand end of the guide rail 12, a second carriage motor 25 to drive the second inkjet heads 22 is provided. When the second carriage motor 25 is activated, the carriage 14 is reciprocated along the guide rail 12 in the right-left direction. A second cleaning unit 86, which will be described later in detail, is situated below a right end portion of the second guide rail 12.

The inkjet printer 1 is equipped with a first platen 4 and a second platen 5, which are identical in their shapes to each other. The first platen 4 and the second platen 5 are to hold the recording media so that the recording media are supported in postures to have images printed thereon. The first platen 4 and the second platen 5 are movable in parallel with an auxiliary direction of the inkjet printer 1. The auxiliary direction is a direction perpendicular to the main scanning direction of the first print heads 21 and the second print heads 22 (i.e., the front-rear direction of the inkjet printer 1).

Each of the first platen 4 and the second platen 5 is a substantially rectangular-shaped flat plate whose shorter side protrudes to an operator. More specifically, a front end of each platen is formed in an obtuse V-like shape protruding toward the front of the inkjet printer 1 so that the recording medium (i.e., a T-shirt) can be placed in the printable posture horizontally over a top surface of the platen.

The inkjet printer 1 is provided with a first tray 8 and a second tray 9 at positions below the first and second platens 4, 5. The first tray 8 and the second tray 9 have surfaces being substantially parallel with the top surfaces of the first and the second platens 4, 5 respectively. The first tray 8 and the second tray 9 are provided to receive overhanging portions of the recording medium such as sleeves of the T-shirt, which are not held by the first and second platens 4, 5. Thus, the first tray 8 and the second tray 9 can prevent the overhanging portions from interfering the base 2 when the T-shirt is installed on the first platen 4 and the second platen 5.

The base 2 is provided with a first guide rail 6 and the second guide rail 7, which are parallel to each other. The first guide rail 6 and the second guide rail support the first platen 4 and the second platen 5 to be movable in the front-rear direction respectively. The first guide rail 5 is provided with a first platen drive motor 40 being a stepping motor at a rear end portion thereof. When the first platen drive motor 40 is activated, the first platen 4 is reciprocated in the front-rear direction along the guide rail 6. The second guide rail 6 is provided with a second platen drive motor 41 being a stepping motor at a rear end portion thereof. When the second platen drive motor 41 is activated, the second platen 5 is reciprocated in the front-rear direction along the guide rail 7.

In the present embodiment, the inkjet printer 1 is equipped with two pairs of the platen and the print heads (i.e., a first pair including the first platen 4 and the first print heads 21 and a second pair including the second platen 5 and the second print heads 22) in order to print images on two pieces of fabric and achieve improved operation efficiency, compared to an inkjet printer having a single pair. However, the number of pair of the platen and the print heads is not limited to two, but may be one, three, or more. Further, the number of platens may not necessarily correspond to the number of print heads, and vice versa. Furthermore, the inkjet printer may have a plurality of print heads to eject inks onto a piece of recording medium sequentially or simultaneously to print an image on the recording medium. For example, in an inkjet printer having one print head to eject white ink and another print head to eject colored ink, a solid white image can be firstly printed with the white ink on the fabric to form a white base layer, and a colored image can be printed over the white layer subsequently with the colored ink. Thus, the colored image can be formed distinctly on the fabric. Similarly, an under-coating layer or a top-coating layer can be formed before or after a subject image is formed on the recording medium. Colorant in the white ink may be, but not limited to, titanium dioxide. The colorant may be, for example, oxidized titanium, zinc oxide, lead oxide, aluminum oxide, barium sulfate, calcium carbonate, silica, and kaolin.

Next, the first print heads 21, from which the ink is ejected, will be described with reference to FIG. 4. According to the present embodiment, the second inkjet heads 22 have substantially identical structures with the first inkjet heads 21; therefore, description of the second inkjet heads 22 will be represented by that of the first inkjet heads 21.

Each of the first inkjet heads 21 includes a base plate 62, a damper case 50 fixed onto an upper portion of the base plate 62, and an inkjet nozzle 60 fixed onto a lower portion the base plate 62.

The base plate 62 is fasten to the carriage 13 with screws (not shown). The damper case 50 is an upright hexahedron case, in which the white ink to be conveyed through the first ink conveyer tube 34 to the inkjet nozzle 60 is reserved. The inkjet nozzle 60 is a hexahedron-shaped piece, which is fixed to the lower portion of the base plate 62. The ink reserved in the damper case 50 is ejected out of the ink jet nozzle 60.

Next, a mechanism to supply the ink to the first print heads 21 will be described with reference to FIGS. 5-7. The inkjet head 1 is provided with a first attachment section 70 on an exterior wall at the right side of the chassis 10 (see also FIG. 1). The first attachment section 70 is a part, to which a first ink supplying unit 31 is detachably attached.

A perspective view of the first ink supplying unit 31 is shown in FIG. 5. A lower left side, an upper right side, a lower right side, and an upper left side in FIG. 5 correspond to frontward, rearward, rightward, and leftward of the first ink supplying unit 31.

The first ink supplying unit 31 includes a box-shaped casing 36, a first ink tank 37, and a spout 38. The first ink tank 37 is installed in the casing 36 and is a bag to contain the white ink therein. The first ink tank 37 includes a tubular portion 371, in which one end of the spout 38 is inserted. The casing 36 has an opening 361, in which the other end of the spout 38 is inserted. In particular, the spout 38 includes a larger cylinder portion 381, a smaller cylinder portion 382, and a resilient sealer 383. A diameter of the larger cylinder portion 381 is larger than a diameter of the smaller cylinder portion 382. An outer diameter of the sealer 383 is slightly larger than the inner diameter of the larger cylinder portion 381, and the sealer 383 is inserted to be tightly fit in the larger cylinder portion 381. The larger cylinder portion 381 of the spout 38 is fixed to the opening 361 of the casing 36 while the smaller cylinder portion 382 is inserted to be tightly fit in the tubular portion 371 of the ink tank 37. Thus, the ink tank 37 and the casing 36 are fixed to each other by the spout 38. When the ink tank 37 and the casing 36 are fixed to each other, the sealer 383 fit in the larger cylinder portion 381 protrudes out of the casing 36.

The first attachment section 70 will be described with reference to FIGS. 6 and 7. A lower right side, an upper left side, an upper fight side, and a lower left side in FIG. 6 correspond to frontward, rearward, rightward, and leftward of the first attachment section 70. The first ink supplying unit 31 and a cleaner processing unit 90, which will be described later in detail, are detachably attached to the first attachment section 70.

The first attachment section 70 is provided includes a cover 71, which is a rectangular-shaped thin plate with a right-end portion and a left-end portion thereof being bent perpendicularly. The first attachment portion 70 further includes a shelf portion 72, on which four first ink supplying units 31 are settled. The shelf portion 72 is a rectangular-shaped plate, which is made of, for example, metal or synthetic resin. Above the shelf portion 72 are arranged four liquid supplying unit holders 78 to hold the first ink supplying units 31.

As shown in FIG. 7, each of the liquid supplying unit holders 78 includes a guide 73 and an ink port 74. The guide 73 is arranged above the shelf portion 72 to guide a position of the first ink supplying unit 31 on the shelf portion 72. The guide 73 is a rectangular-shaped thin plate with a front end and a rear end thereof being bent perpendicularly. An unbent portion of the guide 73 extends in parallel with the shelf portion 72 with space there-between. Thus, the first ink supplying unit 31 is settled in the space between the shelf portion 72 and the guide 73. The ink port 74 is arranged in a midst position between the shelf portion 72 and the guide 73 on the unbent portion of the cover 71. The ink port 74 includes a cylindrical contact portion 75 and a hollow needle 77 held by the contact portion 75. The needle 77 protrudes in the direction parallel with the shelf portion 72 and the guide 73 substantially perpendicular to the unbent portion of the cover 71. Therefore, when the first ink supplying unit 31 is settled in the liquid supplying unit holder 78, the needle 77 pieces through the sealer 383, and the ink contained in the ink tank 37 is allowed to flow through the needle 77.

Thus, the ink port 74 is connected with the spout 38 at one end. Further, the ink port 74 is connected with the first ink conveyer tube 34 (see FIG. 2) at the other end, which is the upstream-side end with respect to the fluid flow. The other end of the ink conveyer tube 34 is further connected to the first print head 21. Therefore, when the first ink supplying unit 31 is attached to the liquid supplying unit holder 78, and the needle 77 pierces through the sealer 383, the white ink contained in the first ink tank 37 is allowed to flow through the spout 38, the needle 77, and the first ink conveyer tube 34, to the first print head 21.

The inkjet head 1 further includes a second attachment section 39 on an exterior wall at the left side of the chassis 10 (see also FIG. 2). The second attachment section 39 is a part, to which a second ink supplying unit 32 is attached. The second ink supplying unit 32 is a unit containing C (cyan) ink, M (magenta) ink, Y (yellow) ink, and K (black) ink. The structure of the second ink supplying unit 32 is similar to that of the first ink supplying unit 32 except the colors of the inks contained therein; therefore, description of that will be omitted. Further, the structure of the second attachment section 39 is similar to the first attachment section 70, and description of that will be omitted.

The second attachment section 39 and the four second print heads 22 are connected with four second ink supplying tubes 35. When the second ink supplying unit 32 is attached to the second attachment section 39, the colored inks contained in the second ink supplying unit 32 are conveyed through the second ink supplying tubes 35 to the second print heads 22.

As shown in FIGS. 2 and 3, at right-hand front of the inkjet printer 1 is provided an operation panel 28, through which a user inputs an instruction to manipulate the first platen 4, the first print heads 21, and the first carriage 13. The first platen 4, the first print heads 21, and the first carriage 13 are as a whole referred to as a first printing unit. The operation panel 28 includes operation buttons 29 for entering instructions and a display 30 being an LCD (liquid crystal display). The operation buttons 29 includes cursor buttons 291 to specify the user's preference, an enter button 292 to enter the specified preference, and a cancel button 293 to cancel a previous selection.

As shown in FIGS. 2 and 3, at left-hand front of the inkjet printer 1 is provided an operation panel 26, through which the user inputs an instruction to manipulate the second platen 5, the second print heads 22, and the second carriage 14. The second platen 5, the second print heads 22, and the second carriage 14 are as a whole referred to as a second printing unit. The operation panel 26 includes operation buttons 23 for entering instructions and a display 27 being an LCD (liquid crystal display). The operation buttons 23 includes cursor buttons 231 to specify the user's preference, an enter button 232 to enter the specified preference, and a cancel button 233 to cancel a previous selection.

Next, a maintenance mechanism to clean the first print heads 21 and the first ink conveyer tubes 34 periodically in order to maintain the operational condition of the inkjet printer 1 will be described with reference to FIGS. 8-10. In the periodic maintenance operation, the colorant in the ink accumulated in the first print heads 21 and the first ink conveyer tubes 34 is removed. The inkjet printer 1 includes two sets of maintenance mechanism, which are to clean the first print heads 21 and the first ink conveyer tubes 34 and to clean the second print heads 22 and the second ink conveyer tubes 35 respectively. The two maintenance mechanisms are similar to each other; therefore, the maintenance operation for the first print heads 21 and the first ink conveyer tubes 34 with one of the two maintenance mechanisms will be described.

During the maintenance operation, the cleaner processing unit 90 is attached to the first liquid supplying unit holder 78 (see FIG. 6) in place of the first ink unit 31. The cleaner processing unit 90 contains cleaner liquid therein, and the cleaner liquid is provided to the first ink conveyer tubes 34 by a first cleaning unit 80 (see FIG. 10).

The cleaner processing unit 90 will be described with reference to FIG. 8. A lower left side, an upper right side, a lower right side, and an upper left side in FIG. 8 correspond to frontward, rearward, rightward, and leftward of the cleaner processing unit 90. The cleaner processing unit 90 includes a box-like shaped casing 91, a cleaner tank 97 containing the cleaner liquid and arranged on a top surface of the casing 91, a spout 98 provided on a front surface of the casing 91, a cleaner conveyer tube 95 to supply the cleaner liquid to the spout 98, and an air supplying tube 96 to supply air to the spout 98. The cleaner conveyer tube 95, the air supplying tube 96, and the spout 98 are connected with one another by a three-way tube 99.

The casing 91 is formed to have a round-shaped opening 918, in which the spout 98 is inserted, at the front surface. The casing 91 is further formed to have an opening 915 and a round-shaped dent 917 at the top surface. The opening 915 is to have the cleaner conveyer tube 95 to penetrate therethrough, and the dent 917 is a portion to have the cleaner tank 97 is attached thereto. Furthermore, the casing 91 is formed to have an opening 916, through which the air supplying tube 96 penetrates, at a rear surface.

The spout 98 includes a larger cylinder portion 981 and a smaller cylinder portion 982, and a resilient sealer 983. A diameter of the larger cylinder portion 981 is larger than a diameter of the smaller cylinder portion 982. An outer diameter of the sealer 983 is slightly larger than the inner diameter of the larger cylinder portion 981, and the sealer 983 is inserted to be tightly fit in the larger cylinder portion 981. The larger cylinder portion 981 of the spout 98 is fixed to the opening 918 of the casing 91 while the smaller cylinder portion 982 is connected to the three-way tube 99 through an intermediate conveyer tube 984. When the larger cylinder portion 981 is fixed to the casing 91 at the opening 918, the sealer 983 fit in the larger cylinder portion 981 protrudes out of the casing 91. The intermediate conveyer tube 984 conveys the fluid drawn in the three way tube 99 further to the spout 98.

The cleaner conveyer tube 95 is inserted in the cleaner tank 97 at one end 951 and connected to the three-way tube 99 at the other end 952. The cleaner conveyer tube 95 is provided with a valve 953, which prevents reverse flow of the cleaner liquid. Further, the cleaner conveyer tube 95 is provided with a filter 954 at a lower stream side of the liquid flow with respect to the valve 953.

The air supplying tube 96 is connected to the three-way tube 99 at one end 961 and protrudes out of the casing 91 through the opening 916 at the other end 962, which is open to the air. As shown in FIG. 9, the one end 961 of the air supplying tube 96 connected to the three-way tube 99 is tapered. The other end 962 of the air supplying tube 96 protruding out of the casing 91 can be covered with a cap 965. If the cap 965 does not cover the air supplying tube 96, the open end 962 of the air supplying tube 96 protruding out of the casing is exposed to air. When the end 962 is covered with the cap 965, air does not flow in the air supplying tube 96. The air supplying tube 96 is provided with a filter 964 and a valve 963 at a lower stream side of the air flow with respect to the filter 964.

The three-way tube 99 is formed to have a shape of "T" in a plane view (see FIG. 9). The three-way tube 99 includes a first straight tube 991 and a second straight tube 992. The second straight tube 992 is arranged to be perpendicular to a lengthwise direction of the first straight tube 991 and extends from an approximate center of the first straight tube 991. The second straight tube 992 is connected with the other end 952 of the cleaner conveyer tube 95. The first straight tube 991 is connected with the intermediate conveyer tube 984 at one end 993 and with the tapered end 961 of the air supplying tube 96 at the other end 994. A tip of the tapered end 961 of the air supplying tube 96 comes to a midst position between the center of the first straight tube 991 and the one end 993 of the first straight tube 991 when the air supplying tube 96 is fully inserted in the straight tube 991.

The cleaner processing unit 90 is attached to the first liquid supplying unit holder 78. When the cleaner processing unit 90 is attached to the liquid supplying unit holder 78, and the needle 77 pierces through the sealer 983, the cleaner liquid contained in the cleaner tank 97 is allowed to flow through the spout 98, the needle 77, and the first ink conveyer tube 34, to the first print head 21.

Next, the first cleaning unit 80 will be described with reference to FIG. 10. The first cleaning unit 80 is provided in the inkjet printer 1 at a position below the right-side end of the first guide rail 11 (see FIG. 2). The first cleaning unit 80 includes a first sealer 81, a first sealer holder 87 (see FIG. 11), a first aspiration tube 82, a first aspiration pump 84, and waste tank 85. The first sealer 81 is capable of covering the inkjet nozzle 60 (see FIG. 4) of the first print head 21 to seal during the maintenance operation and is connected with one end of the first aspiration tube 82. The first sealer holder 87 supports the first sealer 81. The first aspiration pump 84 is arranged in an intermediate position in the first aspiration tube 82. The waste tank 85 is connected with the other end of the first aspiration tube 82.

When the maintenance operation starts, the first sealer holder 87 holding the first sealer 81 is moved to have the first sealer 81 to cover the inkjet nozzle 60, and the aspiration pump 84 is activated. Accordingly, liquid (i.e., the white ink or the cleaner liquid) remaining in the first print head 21 is collected by the aspiration through the first aspiration tube 82 and the first sealer 81. The collected liquid is led to the waste tank 85 to be discharged out of the inkjet printer 1. When the liquid remained in the first print head 21 is removed, negative pressure is generated in the first print head 21. Accordingly, the cleaner liquid contained in the cleaner tank 97, which is in fluid communication with the first print head 21, is aspirated and led to be supplied to the first print head 21.

Next, referring to FIG. 11, an electrical configuration of the inkjet printer 1 will be described. The inkjet printer 1 includes a main controlling circuit 100 to control entire behaviors of the inkjet printer 1, a first print control circuit 120 to control behaviors of the first printing unit, and a second print control circuit 140 to control behaviors of the second printing unit.

The main controlling circuit 100 includes a CPU 110 that controls the entire operation in the inkjet printer 1. The CPU 110 is connected with a ROM 120 and a RAM 130 through a bus 104. The ROM 120 stores various controlling programs to be executed in the CPU 110. The RAM 130 temporarily stores data concerning the operations in the inkjet printer 1. The CPU 101 is connected with the first print control circuit 120 and the second print control circuit 140 through the bus 104. Further, the inkjet printer 1 includes a communication unit 107, which is connected to the CPU 101 through the bus 104, and the communication unit 107 is connected with a PC 108, which can create print data.

The first print control circuit 120 includes a first print head drive circuit 121, a first carriage motor drive circuit 122, and a first platen motor drive circuit 123. The first print head drive circuit 121 drives piezoelectric actuators for each of ink channels in the first print heads 21. The first carriage motor drive circuit 122 drives the first carriage motor 24. The first platen motor drive circuit 123 activates the first platen drive motor 40. The first print control circuit 120 further includes a first operation panel control circuit 125, which controls behaviors of the first operation panel 28. The first operation panel control circuit 125 accepts the user's inputs through the operation buttons 29 and outputs images through the display 30. The first print control circuit 120 further includes a first maintenance control circuit 147, which controls the movement of the first sealer holder 87 and the first aspiration pump 84.

The second print control circuit 140 includes a second print head drive circuit 141, a second carriage motor drive circuit 142, and a second platen motor drive circuit 143. The second print head drive circuit 141 drives piezoelectric actuators for each of ink channels in the second print heads 22. The second carriage motor drive circuit 142 drives the second carriage motor 25. The second platen motor drive circuit 143 activates the second platen drive motor 41. The second print control circuit 140 further includes a second operation panel control circuit 126, which controls behaviors of the second operation panel 26. The second operation panel control circuit 126 accepts the user's inputs through the operation buttons 23 and outputs images through the display 27. The second print control circuit 140 further includes a second maintenance control circuit 148, which controls the movement of a second sealer holder 88 and a second aspiration pump 83.

Next, storage areas provided in the RAM 103 of the main controlling circuit will be described with reference to FIG. 12. The RAM 103 includes a first print data storage area 1031, a second print data storage area 1032, a first cleaning head storage area 1033, a second cleaning head storage area 1034, and a cleaning history storage area 1035. The first print data storage area 1031 stores print data to print an image in the white ink ejected by the first print heads 21. The second print data storage area 1032 stores print data to print an image in the colored inks ejected by the second print heads 22. The first cleaning head storage area 1033 stores information concerning the first print head 21 to be cleaned. The second cleaning head storage area 1034 stores information concerning the second print head 22 to be cleaned. The cleaning history storage area 1035 stores a number of cleaning operations having been conducted.

Next, a cleaning behavior to clean the first print head 21 and the first ink conveyer tube 34 will be described with reference to FIGS. 10 and 13. As shown in FIG. 13, the cleaning behavior includes a preparation step (S1), a fluid circulation step (S2), in which the cleaner liquid and air is introduced, and an air supply step (S3), in which air is supplied to the first print head 21. The fluid circulation step (S2) includes a liquid circulation step (S21) and an air blending step (S22).

Each step will be described in detail. In S1, the first ink supplying unit 31, which has been used in the printing operation, is removed from the liquid supplying unit holder 78. In place, the cleaner processing unit 90 is attached to the liquid supplying unit holder 78. Further, the open end 962 of the air supplying tube 96 is covered with the cap 965 (see FIG. 10). The cap 965 attached to the end 962 of the air supplying tube 96 prevents air to be introduced in the air supplying tube 96.

In S2, firstly, liquid circulation (S21) is performed. In S21, the first sealer 81 (see FIG. 10) is attached to cover the inkjet nozzle 60, and the first aspiration pump 84 is activated. Accordingly, the ink remaining in the first print head 21 is aspirated by the aspiration force of the first aspiration pump 84 and collected to be stored in the waste tank 85. In accordance with the negative pressure generated by the removal of the remaining ink, the cleaner liquid contained in the cleaner tank 97, which is in fluid communication with the first print head 21, is led to the first print head 21. As shown in FIG. 14, the cleaner liquid is thus led to the first ink conveyer tube 34 through the cleaner conveyer tube 95, the three-way tube 99, and the intermediate conveyer tube 984.

In S2, secondly, air is introduced in the circulated cleaner liquid (S22). In S22, the cap 965 is removed from the end 962 of the air supplying tube 96. Accordingly, the fluid in the air supplying tube 96 is released. The first aspiration pump 84 is again activated.

The cleaner liquid flows in the three-way tube 99 in S21 from the open end of the second straight tube 992 and toward the end 993 of the first straight tube, as indicated in solid arrows in FIG. 15. The tapered end 961 of the air supplying tube 96 is in the position between the center of the first straight tube 991 and the end 993. In other words, the tapered end 961 of the air supplying tube 96 is in a position midst of the liquid flow, which can be generated by the first aspiration pump 84. When the liquid flow is generated, negative pressure is generated in the three-way tube 99 by the ejector effect. Meanwhile, the other end 962 of the air supplying tube 96 is open to the air; therefore, the air is drawn to be blended in the cleaner liquid in the three-way tube 99. The air drawn in the three-way tube 99 is distributed in bubbles in the cleaner liquid. Thus, the air-liquid two-phased cleaner, i.e., the cleaner liquid containing bubbles, is generated in the cleaner processing unit 90 and supplied to the first ink conveyer tube 34 and the first print head 21 through the intermediate conveyer tube 984 and the spout 98.

The bubbles in the cleaner liquid can improve cleaning efficiency of the cleaner liquid. That is, the bubbles distributed in the cleaner liquid collide with one another and with inner surfaces of the first ink conveyer tube 34 and the first print head 21 when the liquid flows in the first ink conveyer tube 34 and the first print head 21. Collision of the bubbles causes turbulent flows in the cleaner liquid; therefore, the inner surfaces of the first ink conveyer tube 34 and the first print head 21 can be substantially exposed to the turbulent flows of the cleaner liquid. Accordingly, sheltering spots, in which the colorant in the ink can accumulate, can be excluded from the first ink conveyer tube 34 and the first print head 21. Thus, the colorant, which may otherwise adhere to the sheltering spots, can be effectively removed.

If the cleaner liquid without the turbulent flows is flushed, the cleaner liquid flowing in an axial center portion of the first ink conveyer tube 34 can be delivered to the waste tank 85 without being exposed to the inner surfaces of the first ink conveyer tube 34 or the first print head 21. In other words, a certain portion of the cleaner liquid can be wasted without being used. Therefore, when the cleaner liquid with turbulent flows is flushed, the portion to be wasted can be reduced, and the cleaner liquid can be effectively used.

Further, if the cleaner liquid without the turbulent flows is flushed, molecular viscosity increased in the vicinity of the inner surface of the first ink conveyer tube 34, and a viscous sublayer without turbulence can be created. When bubbles are distributed in the cleaner liquid, however, the bubbles collide with the inner surfaces of the first ink conveyer tube 34 and agitate the liquid flow in the vicinity of the inner surface. Therefore, the colorant adhered to the inner surface of the first ink conveyer tube 34 can be removed therefrom by the turbulent flows. Thus, the cleaning ability of the cleaner liquid can be improved, and the ink containing the colorant such as titanium dioxide having higher specific gravity can be effectively flushed. Further, when the cleaner liquid contains bubbles, an amount of the cleaner liquid to be used in one cleaning behavior can be reduced.

In the air blending step in S22, the first aspiration pump 84 is activated intermittently. When the flow of the cleaner liquid with bubbles blended is once stopped and released again, the turbulence in the cleaner liquid is enhanced. Therefore, the cleaning efficiency can be improved even more.

Following S22, in S3, air is supplied to the first print head 21. In S3, the cleaner conveyer tube 95 is removed from the cleaner tank 97 (see FIGS. 8 and 10). Accordingly, the open end 951 of the cleaner conveyer tube 95 is exposed to the air. The first aspiration pump 84 is activated. Therefore, the air is drawn in the first ink conveyer tube 34 through the cleaner conveyer tube 95, the air supplying tube 96, and the three-way tube 99, as indicated in double-dotted arrows in FIG. 16. In this regard, the cleaner liquid is not drawn in the three-way tube 99 or to the first ink conveyer tube 34.

When the air is introduced to the first ink conveyer tube 34, therefore, the cleaner liquid with bubbles remaining in the first ink conveyer tube 34 and the first print head 21 is replaced with the air. Accordingly, the bubbles in the first ink conveyer tube 34 and the first print head 21 can be removed therefrom, and the ink path in the first ink conveyer tube 34 and the first print head 21 is prevented from being narrowed when a printing operation is resumed. Further, the bubbles can be prevented from being left in the first ink conveyer tube 34 and the first print head 21 so that failure of ink ejection due to the remaining bubbles during the printing operation can be avoided.

Next, a cleaning operation to be executed in the inkjet printer 1 will be described with reference to FIG. 17. In the cleaning operation, a cycle of activation and inactivation of the first aspiration pump 84 is repeated for seven times. In the present embodiment, the cleaning operation includes a first cleaning operation, in which the first print heads 21 and the first ink conveyer tubes 34 are cleaned, and a second cleaning operation, in which the second print heads 22 and the second ink conveyer tubes 35 are cleaned. The first cleaning operation and the second cleaning operation are substantially similar to each other; therefore, description of the second cleaning operation is represented by description of the first cleaning operation. The first cleaning operation is started when an operator of the inkjet printer 1 manipulates handles the first buttons 29 in the first operation panel 28 to activate the first cleaning operation. When the user enters an option "tube cleaning," which is one of options presented to the operator through a maintenance menu window being displayed in the display 30, the CPU 101 activates the first cleaning operation according to a cleaning program stored in the ROM 102.

In S31, a head selection window, in which one of the first print heads 21 to be cleaned is selected, is displayed in the display 30. In the head selection window, for example, the name of the selected option, "tube cleaning," is indicated in a top line. Further, options "White 1," "White 2," "White 3," and "White 4" are presented. In the present embodiment, the option "White 1" refers to the first print head 21 at the rightmost position, the option "White 2" refers to the first print head 21 at a position second to the right, the option "White 3" refers to the first print head 21 at a position third to the right, and the option "White 4" refers to the first print head 21 at a position fourth to the right (i.e., the leftmost position). The operator handles the cursor buttons 291 to specify one of the options and enter the selection with the enter button 292.

In S32, the CPU 101 judges as to whether the operator's selection of the first print head 21 to be cleaned is entered. When the selection is entered (S32: YES), in S33, the number assigned to the selected first print head 21 (i.e., one of 1, 2, 3, 4) is stored in the first cleaning head storage area 1033 in the RAM 103. If the enter button 292 is not pressed, and no selection is made (S32: NO), the CPU 101 repeats S32.

Following S33, in S34, a message to prompt the operator to attach the cap 965 to the open end 962 of the air supplying tube 96 is displayed in the display 30. The message may be, for example, "attach the cap and press the enter button." Thus, the user's attention is drawn so that the cap 965 should be attached to the open end 962 of the air supplying tube 96.

In S35, the CPU 101 judges as to whether an instruction to start the cleaning behavior is entered by the operator. If the enter button 292 is pressed, the CPU 101 determines that the instruction is entered (S35: YES). In S36, history of the cleaning operation, i.e., a number (N) of cleaning behaviors having been performed in the cleaning operation, stored in the cleaning history storage area 1035 in the RAM 103, is initialized to zero (N=0). In S35, if the enter button 292 is not pressed (S35: NO), the CPU 101 repeats S35.

Following S36, in S37, the first sealer holder 87 is manipulated by the first maintenance control circuit 147 to have the first sealer 81 to cover the inkjet nozzle 60 of the selected first print head 21. In S37, the first maintenance control circuit 147 manipulates the first aspiration pump 84 to rotate for 50 times. Accordingly, the white ink remaining in the selected first print head 21 is aspirated due to the negative pressure caused by the first aspiration pump 84 and collected to be stored in the waste tank 85. Further, the cleaner liquid contained in the cleaner tank 97, which is in fluid communication with the first print head 21, is drawn to the first ink conveyer tube 34.

After 50 times of rotation of the first aspiration pump 84 in S37, in S38, a message to prompt the operator to remove the cap 965 from the end 962 of the air supplying tube 96 is displayed in the display 30. The message may be, for example, "remove the cap and press the enter button." Thus, the user's attention is drawn so that the cap 965 should be removed from the end 962 of the air supplying tube 96.

In S39, the CPU 101 judges as to whether an instruction to start the fluid circulation is entered by the operator. If the enter button 292 is pressed, the CPU 101 determines that the instruction is entered (S39: YES). In S40, the history of the cleaning operation (i.e., N), stored in the cleaning history storage area 1035 in the RAM 103, is incremented by one (N=1). In S39, if the enter button 292 is not pressed (S39: NO), the CPU 101 repeats S39.

Following S40, in S41, the first maintenance control circuit 147 manipulates the first aspiration pump 84 to rotate for 150 times. In this regard, because the end 962 of the air supplying tube 96 is exposed to the air, the air is drawn due to the negative pressure caused by the first aspiration pump 84 and form bubbles in the cleaner liquid in the first ink conveyer tube 34 and the first print head 21. Thus, the cleaner liquid containing bubbles is supplied to the first ink conveyer tube 34 and the first print head 21.

After 150 times of rotation of the first aspiration pump 84 in S41, in S42, the first aspiration pump 84 is inactivated for 10 seconds. In S43, the number N stored in the cleaning history storage area 1035 is referred to, and it is judged as to whether the number N of the cleaning behaviors has reached 7. When the number N of the cleaning behaviors having been performed in the cleaning operation is smaller than 7 (S43: NO), the CPU 101 repeats S40-S43. Thus, the cleaner liquid with bubbles blended is supplied to the first ink conveyer tube 34 and the first print head 21 intermittingly for a plurality of times, specifically for 7 times in the present embodiment.

When the number N of the cleaning behaviors having been performed in the cleaning operation has reached 7 (S43: YES), a message to prompt the operator to remove the cleaner conveyer tube 95 from cleaner tank 97 is displayed in the display 30. The message may be, for example, "remove the tube from the cleaner tank and press the enter button." Thus, the user's attention is drawn so that the cleaner conveyer tube 95 should be removed from the cleaner tank 97.

In S45, the CPU 101 judges as to whether an instruction to start the air supply is entered by the operator. If the enter button 292 is pressed, the CPU 101 determines that the instruction is entered (S45: YES). In S46, the first maintenance control circuit 147 manipulates the first aspiration pump 84 to rotate for 150 times. In S45, if the enter button 292 is not pressed (S45: NO), the CPU 101 repeats S45.

After 150 times of rotation of the first aspiration pump 84 in S46, in S47, it is judged as to whether an instruction to terminate the cleaning operation is entered by the operator. If the cancel button 293 is pressed, the CPU 101 determines that the instruction is entered (S47: YES) and terminates the operation. In S47, if the cancel button 292 is not pressed (S47: NO), the flow returns to S31, and the CPU 101 repeats S31-S47.

According to the above inkjet printer 1 performing the above cleaning operation, the cleaner liquid with bubbles blended is supplied from the cleaner processing unit 90 to the first ink conveyer tube 34 and drawn to the first print head 21. The bubbles contained in the cleaner liquid collide with one another when the cleaner liquid flows in the first ink conveyer tube 34 and the first print head 21 to produce turbulent flows. Thus, the turbulent flows remove the colorant adhered to the inner surfaces of the first ink conveyer tube 34 and the first print head 21.

The cleaner liquid with bubbles is flushed in the first conveyer tube 34 and the first inkjet head 21 intermittingly so that turbulence in the cleaner liquid is enhanced. Therefore, the cleaning efficiency of the cleaner liquid can be improved.

In the cleaning behavior, after flushing the cleaner liquid with bubbles in the first ink conveyer tube 34 and the first print head 21, solely the air is drawn in the first ink conveyer tube 34 and the first print head 21 in order to remove the bubbles remaining in the first ink conveyer tube 34 and the first print head 21. Therefore, the ink path in the first ink conveyer tube 34 and the first print head 21 is prevented from being narrowed when a printing operation is resumed. Further, the bubbles can be prevented from being left in the first ink conveyer tube 34 and the first print head 21 so that failure of ink ejection due to the remaining bubbles during the printing operation can be avoided.

In the cleaner processing unit 90, the cleaner liquid flows in the three-way tube 99 through the open end of the second straight tube 992 and toward the end 993 of the first straight tube 991. Meanwhile, the tip of the tapered end 961 of the air supplying tube 96 is in the midst position between the center of the first straight tube 991 and the end 993 of the first straight tube 991 when the air supplying tube 96 is fully inserted in the straight tube 991. In other words, the tapered end 961 of the air supplying tube 96 is in a position midst of the liquid flow. Therefore, when the liquid flow is generated, negative pressure is generated in the three-way tube 99 by the ejector effect, and the air is drawn and distributed in bubbles in the cleaner liquid in the three-way tube 99. Thus, bubbles can be distributed in the cleaner liquid by a less complicated mechanism in the cleaner processing unit 90.

In the cleaner processing unit 90, the open end 962 of the air supplying tube 96 can be covered with the cap 965. When the open end 962 is uncovered and released to the air, and the cleaner liquid is flushed in the cleaner conveyer tube 95, the air is introduced through the tapered end 961 of the air supplying tube 96. Accordingly, bubbles are contained in the cleaner liquid. When the open end 962 is covered with the cap 965, and when the cleaner liquid is flushed in the cleaner conveyer tube 95, the air is not introduced in the cleaner liquid, and the cleaner liquid without bubbles is flushed in the first ink conveyer tube 34 and the first print head 21. Thus, solely the cleaner liquid can be flushed with the simple operation of attaching the cap 965 to the open end 962 of the cleaner conveyer tube 95.

The casing 91 of the cleaner processing unit 90 is formed to have the dent 917 at the top surface thereof. The cleaner tank 97 is fitted to be set in the dent 917, and the open end 951 of the cleaner conveyer tube 95 is disposed in the cleaner tank 97. The cleaner tank 97 is set in the dent 917, which is on the outer side of the casing 91 and exposed to the open air. Therefore, the open end 951 of the cleaner conveyer tube 95 can be easily removed out of the cleaner tank 97, and supplying the cleaner liquid to the first ink conveyer tube 34 and the first print head 21 can be easily stopped by removal of the cleaner conveyer tube 95 out of the cleaner tank 97. Further, when the cleaner liquid in the cleaner tank 97 is consumed, the old cleaner tank 97 can be easily removed from the casing 91 and replaced with a new cleaner tank 97. Thus, the cleaner processing unit 90 can be repeatedly used even after use of the cleaner liquid in one cleaner tank 97.

In the first cleaning unit 80 of the inkjet printer 1, the first aspiration tube 81 is connected to the first print head 21, and the first aspiration pump 84 is provided in the midst of the first aspiration tube 81. Therefore, when the first aspiration tube 81 is activated, the liquid remaining in the first print head 21 can be removed therefrom. Further, the cleaner liquid can be supplied from the cleaner processing unit 90 to the first print head 21 by the same first aspiration pump 84. Accordingly, the first ink conveyer tube 34 and the first print head 21 can be cleaned with the less complicated structure. Furthermore, a speed and timing of the flow of the liquid provided by the first aspiration pump 84 can be controlled under control of the first maintenance control circuit 147.

Although an example of carrying out the invention has been described, those skilled in the art will appreciate that there are numerous variations and permutations of the cleaner unit, the inkjet printer with the cleaner unit, and the method to clean the inkjet printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the air is not necessarily introduced in the cleaner liquid by use of the ejector effect in the cleaner processing unit 90 as long as the air is blended in the cleaner liquid when the cleaner liquid flows through the spout 98 and is drawn in the first ink conveyer tube 34. Therefore, for example, a container containing the cleaner liquid and the air may be shaken prior to the maintenance operation to have the air blended in the cleaner liquid within the container. The container may be shaken manually by the operator or automatically by, for example, a shaker mechanism. In this configuration, the container may be connected with the intermediate conveyer tube 984, and the components in the cleaner processing unit 90 provided in the upper stream of the fluid flow with respect to the intermediate conveyer tube 984 may be omitted. Alternatively, the container may be directly connected to the smaller cylinder portion 982 of the spout 98, and the intermediate conveyer tube 984 may be omitted. In such a configuration, a connecting portion of the container connected to the smaller cylinder portion 982 conveys the air-liquid two-phased cleaner to the spout 98.

For another example, the cleaner conveyer tube 95 may be formed to have a narrowed portion, in which the path of the cleaner liquid is narrowed. Further, the air supplying tube 96 is connected to the three-way tube 99 with the tapered end 961 to be in the vicinity of the narrowed portion. The liquid flows faster in the vicinity of the narrowed portion; therefore, negative pressure is generated in the three-way tube 99, and the air is drawn through the air supplying tube 96 in the cleaner liquid. Thus, bubbles can be distributed in the cleaner liquid by the less complicated mechanism in the cleaner processing unit 90.

For another example, further, in the above air blending step (S22), supply of the cleaner liquid is stopped by removal of the cleaner conveyer tube 95 out of the cleaner tank 97. However, the supply may be stopped by removal of the cleaner processing unit 90 from the first liquid supplying unit holder 78. When the cleaner processing unit 90 is removed from the first liquid supplying unit holder 78, the needle 77 is exposed to the air. When the first aspiration pump 84 is activated with the needle 77 exposed, the air can be introduced through the exposed needle 77 to the first ink conveyer tube 34. In this configuration, for example, a sensor to detect presence and absence of the cleaner processing unit 90 on the first liquid supplying unit holder 78 may be provided. When the air supply step (S3) is performed, and the sensor detects the cleaner processing unit 90 attached to the first liquid supplying unit holder 78, an error indication may be presented to the operator. Accordingly, failure to supply the air in the air supply step (S3) can be prevented. Additionally, the cleaner processing unit 90 may be replaced with an air filter unit (not shown) having the casing 91, the spout 98, the air supplying tube 96, and the filter 964 during the air supply step (S3). With this air filter unit, the first ink conveyer tube 34 is protected from the dust in the air.

The above embodiment of the present invention can be effectively applied to the inkjet printer using the white ink, of which specific gravity is 1.1 or more. However, even when the specific gravity of the colorant is less than 1.1, the cleaning method of the above embodiment can be also applied when the inner surface of the ink conveyer tube having colorant adhered onto is cleaned. The inner surface of the ink conveyer tube can be still effectively cleaned by the cleaner liquid with colliding bubbles. In this case, due to the specific gravity of the colorant, which is smaller than the specific gravity of the white ink, the inner surface of the ink conveyer tube can be cleaned in shorter time and in a smaller amount of the cleaner liquid.

In the above embodiments, the inkjet head is used in the inkjet printer 1, which is to print an image on a piece of fabric being the recording medium. However, the present invention can be similarly applied to an inkjet printer which is capable of printing an image on a sheet of paper and other recording medium, in place of a piece of fabric, in inks. Moreover, the present invention can be effectively applied to an ink applying apparatus, which ejects, for example, ultraviolet curable ink or other ultraviolet curable agent (e.g., foundation coat and overcoat) to surfaces of an object.

What is claimed is:

1. A cleaner unit for an inkjet head and an ink conveyer tube to convey ink to the inkjet head, comprising:

an air-liquid two-phased cleaner conveyer tube, which conveys air-liquid two-phased cleaner;

a cleaner spout, which is connected to an upstream-side end of the ink conveyer tube and to a downstream-side end of the air-liquid two-phased cleaner conveyer tube with respect to a fluid flow, and through which the air-liquid two-phased cleaner is supplied to the ink conveyer tube, and an air-liquid two-phased cleaner generator, which is configured to blend air in the cleaner liquid and generate the air-liquid two-phased cleaner, the air-liquid two-phased cleaner generator comprising:

a cleaner conveyer tube, which is configured to convey the cleaner liquid therethrough;

an air blending piece, which is arranged to be connected with the cleaner conveyer tube and blends air in the cleaner liquid conveyed in the cleaner conveyer tube, the air blending piece being formed to have a shape of T in a plane view and including a first straight tube and a second straight tube, the second straight tube being arranged to be perpendicular to a lengthwise direction of the first straight tube and extending from an approximate center of the first straight tube; and an air supplying tube, which is connected to the air blending piece at one end and exposed to the air at the other end, the air supplying tube being tapered at the one end connected to the air blending piece, the tapered one end being in a midst position between the approximate center of the first straight tube and one end of the first straight tube.

2. The cleaner unit according to claim 1, further comprising a cover that is configured to detachably cover the exposed end of the air supplying tube.

3. The cleaner unit according to claim 1, further comprising:

a tank attachment portion, to which a cleaner tank containing the cleaner liquid is attached, wherein an open end of the cleaner conveyer tube is disposed in the cleaner tank, attached to the tank attachment portion, the open end of the cleaner conveyer tube being on an upstream-side of the fluid flow.

4. The cleaner unit according to claim 1, wherein the ink has specific gravity of at least 1.1.

5. The cleaner unit according to any of claim 1, wherein the ink contains white colorant.

6. The cleaner unit according to claim 1, wherein the ink contains titanium dioxide.

7. An inkjet printing apparatus, comprising:

an inkjet head, which is configured to eject ink to form an image on a recording medium;

an ink conveyer tube, which is configured to connect an ink supplying unit with the inkjet head and convey the ink to the inkjet head; and a cleaner unit to clean the inkjet head and the ink conveyer tube in cleaning liquid, wherein the cleaner unit includes:

an air-liquid two-phased cleaner conveyer tube, which conveys air-liquid two-phased cleaner; and a cleaner spout, which is connected to an upstream-side end of the ink conveyer tube and to a downstream-side end of the air-liquid two-phased cleaner conveyer tube with respect to a fluid flow, and through which the air-liquid two-phased cleaner is supplied to the ink conveyer tube;

an air-liquid two-phased cleaner generator, which is configured to blend air in the cleaner liquid and generate the air-liquid two-phased cleaner, the air-liquid two-phased cleaner generator comprising:

a cleaner conveyer tube, which is configured to convey the cleaner liquid therethrough;

an air blending piece, which is arranged to be connected with the cleaner conveyer tube and blends air in the cleaner liquid conveyed in the cleaner conveyer tube, the air blending piece being formed to have a shape of T in a plane view and including a first straight tube and a second straight tube, the second straight tube being arranged to be perpendicular to a lengthwise direction of the first straight tube and extending from an approximate center of the first straight tube; and an air supplying tube, which is connected to the air blending piece at one end and exposed to the air at the other end, the air supplying tube being tapered at the one end connected to the air blending piece, the tapered one end being in a midst position between the approximate center of the first straight tube and one end of the first straight tube.

8. The inkjet printing apparatus according to claim 7, further comprising a cover that is configured to detachably cover the exposed end of the air supplying tube.

9. The inkjet printing apparatus according to claim 7, further comprising:

a tank attachment portion, to which a cleaner tank containing the cleaner liquid is attached, wherein an open end of the cleaner conveyer tube is disposed in the cleaner tank attached to the tank attachment portion, the open end of the cleaner conveyer tube being on an upstream-side of the fluid flow.

10. The inkjet printing apparatus according to claim 7, wherein the ink has specific gravity of at least 1.1.

11. The cleaner unit according to claim 7, wherein the ink contains white colorant.

12. The inkjet printing apparatus according to claim 7, wherein the ink contains titanium dioxide.

13. The inkjet printing apparatus according to claim 7, further comprising:

a discharger tube, which is connected with the inkjet head and lead the air-liquid two-phased cleaner in the inkjet head to be discharged out of the inkjet printing apparatus; and an aspiration pump, which is arranged in midst of the discharger tube to aspirate the fluid in the inkjet head.

14. The inkjet printing apparatus according to claim 7, further comprising:

an attachment section, to which the ink supplying unit is configured to be detachably attached, wherein the cleaner unit is detachably attached to the attachment section.

15. A method to clean an inkjet head and an ink conveyer tube that conveys an ink to the inkjet head, the method being performed by using the cleaner unit of claim 1, the method comprising:

blending air in cleaner liquid to generate air-liquid two-phased cleaner; and supplying the air-liquid two-phased cleaner to the ink conveyer tube and the inkjet head.

16. The method according to claim 15, wherein the air-liquid two-phased cleaner is generated by blending air in the cleaner liquid.

17. The method according to claim 15, wherein the air-liquid two-phased cleaner is generated by:

circulating the cleaner liquid in an air-liquid two-phased cleaner generator; and introducing air in the air-liquid two-phased cleaner generator to generate bubbles in the cleaner liquid.

18. The method according to claim 17, wherein the air-liquid two-phased cleaner is supplied to the ink conveyer tube intermittingly.

19. The method according to claim 15, wherein solely the air is supplied to the ink conveyer tube after the air-liquid two-phased cleaner is supplied to the ink conveyer tube and the inkjet head.

* * * * *